US006880515B2

(12) United States Patent
Geyer et al.

(10) Patent No.: US 6,880,515 B2
(45) Date of Patent: Apr. 19, 2005

(54) PORTABLE HAND-GUIDED WORK APPARATUS

(75) Inventors: Werner Geyer, Berglen (DE); Claus Fleig, Ludwigsburg (DE); Bernd Knödler, Winnenden (DE); Jörg Schlossarczyk, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/385,530

(22) Filed: Mar. 12, 2003

(65) Prior Publication Data

US 2003/0172899 A1 Sep. 18, 2003

(30) Foreign Application Priority Data

Mar. 15, 2002 (DE) ..... 102 11 404

(51) Int. Cl.[7] ..... F02B 77/00
(52) U.S. Cl. ..... 123/198 E; 123/184.21
(58) Field of Search ..... 123/198 E, 184.21, 123/184.23

(56) References Cited

U.S. PATENT DOCUMENTS 5,503,649 A 4/1996 Nickel
5,582,146 A 12/1996 Linsbauer et al.
6,328,288 B1 * 12/2001 Gerhardy ..... 261/35
6,415,750 B1 7/2002 Rosskamp et al.
6,595,169 B1 * 7/2003 Raffenberg et al. ..... 123/73 A
2001/0011531 A1 8/2001 Uenoyama et al.

FOREIGN PATENT DOCUMENTS

JP 2001342837 12/2001
WO WO 01/51783 7/2001

* cited by examiner

*Primary Examiner*—Thomas Denion
*Assistant Examiner*—Zelalem Eshete
(74) *Attorney, Agent, or Firm*—Walter Ottesen

(57) ABSTRACT

A portable hand-guided work apparatus (1), such as a motor-driven chain saw, cutoff machine or the like, includes an internal combustion engine (2) and an air filter (10). At least one air channel (8) and an intake channel (7) are provided which fluidly connect the internal combustion engine (2) to the clean side of the air filter (10). The intake channel (7) is configured at least partially in a carburetor (9). The air channel (8) opens at an air channel opening (13, 13', 13") and the intake channel (7) opens at an intake opening (12) at the clean side of the air filter (10). Air channel opening (13, 13', 13") and intake opening (12) open spatially separate from each other at the clean side of the air filter (10). To prevent the entry of fuel into the air channel (8) from the intake channel (7), the intake opening (12) in the normal work position of the work apparatus (1), seen in the effective direction (17) of the gravity force, has an elevation offset (a, a', a") relative to the air channel opening (13, 13', 13").

17 Claims, 4 Drawing Sheets

PORTABLE HAND-GUIDED WORK APPARATUS

BACKGROUND OF THE INVENTION

Internal combustion engines draw in an air/fuel mixture via an intake channel and additional combustion air via an air channel. The intake channel is opened only over a specific range of a crankshaft revolution. Especially in two-stroke engines, the intake channel is otherwise closed by the piston. A pressure wave occurs in the intake channel because of the periodic opening and closing of the intake channel to the crankcase. The pressure wave is alternately directed toward the crankcase and toward the air filter. The pressure wave can propagate up to the air filter and can tear fuel droplets from the intake channel along into the air filter. In this way, fuel droplets from the air filter can also reach the air channel.

It is known from U.S. Pat. No. 5,582,146 to mount a baffle pot on the air filter in the direction toward the intake channel. This baffle pot is intended to catch fuel droplets thrown back from the intake channel. The fuel collected there is to be carried by the air flow back into the intake channel. A baffle pot of this kind, however, partially covers the opening of the intake channel so that the intake resistance increases. The baffle pot defines an additional component which increases the complexity in production, assembly and storage.

It is known from U.S. Pat. No. 6,415,750 that air channel and intake channel open into separate chambers on the clean side of the air filter. Different pressures can be present in the chambers whereby the mixing ratio of fuel and air changes and the combustion can be hindered.

It is known from U.S. Pat. No. 5,503,649 to mount two rows of air resistance elements between the intake opening and the housing interior space on which fuel and oil should deposit. The rows of air resistance elements lie at a spacing to each other and lead likewise to different pressures at the intake channel and at the air channel.

SUMMARY OF THE INVENTION

The invention has as its basis the task of providing a portable, hand-guided work apparatus of the type according to the class wherein it is avoided in a simple manner that fuel reaches the air channel.

The portable handheld work apparatus of the invention has a normal work position during operation thereof. The portable handheld work apparatus includes: an internal combustion engine having an air channel and an intake channel; a carburetor defining a portion of the intake channel; an air filter having a clean aide and being mounted upstream of the carburetor; the air channel and the intake channel fluidly connecting the engine to the clean side of the air filter; the clean side having an air channel opening and an intake channel opening formed therein; the air channel opening into the air channel opening and the intake channel opening into the intake channel opening; the air channel opening and the intake channel opening being disposed in spaced relationship to each other and the clean side; and, the intake channel opening being offset (a, a', a") in elevation relative to the air channel opening viewed in the acting direction of gravitational force when the work apparatus is in the normal work position.

The arrangement of air channel opening and intake opening with an elevation offset substantially prevents the penetration of fuel into the air channel. The intake opening is mounted especially below the air channel opening. With the geodetic separation, it is ensured in the normal work position that the fuel droplets do not reach the region of the air channel opening because of gravity. Advantageously, the intake opening and the air channel opening are offset relative to each other in the width of the air filter housing by a width offset and have, especially, a spacing from each other.

Advantageously, the air channel opening and intake opening are spatially separated from each other by at least one adjusting wall in the air filter housing. The adjusting wall has a spacing to the air filter housing on at least one side thereof. The fluid connection, which is realized by the spacing, ensures the pressure compensation between air channel and intake channel. A communicating clean space is thereby formed on the clean side of the air filter. The adjusting wall ensures that no fuel reaches the air channel also when tilting the work apparatus. In this way, a complete separation of clean air path and mixture path is realized without different pressure levels forming. The adjusting wall is purposefully mounted approximately parallel to the flow direction in the intake channel in order to not increase the flow resistance. Advantageously, the adjusting wall extends over the entire depth and over most of the elevation of the air filter housing, especially from the base of the air filter housing up to just below the roof. In this way, a free gas exchange is ensured with simultaneous gravity separation so that no fuel droplets can reach the air channel from the intake channel.

To realize a slight flow resistance of the air filter housing, this housing ham air openings separated by ribs. The air openings are covered by filter material. An advantageous arrangement results when intake opening and air channel opening open into the forward wall of the air filter housing. The front wall is the wall of the air filter housing which faces toward the internal combustion engine. The back wall of the air filter housing lies opposite the front wall and is at least in one region suitably configured to be inclined to the front wall. The inclined region extends starting from the roof of the air filter housing to approximately the center of the back wall. The region of the air filter housing lying opposite the intake opening has no air opening and advantageously no filter material in order to prevent the contamination of the air filter with fuel. A compact configuration is achieved when the compensation channel of the carburetor is at a spacing from the intake opening and especially opens opposite to the effective direction of the gravity flow at the clean side of the air filter and advantageously at the front wall of the air filter. The carburetor is configured as a membrane carburetor. In this way, the same pressure level is present at the compensation connection as at air channel and intake channel. In this way, a constant mixing ratio of fuel and air is realized independently of the degree of contamination of the air filter.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
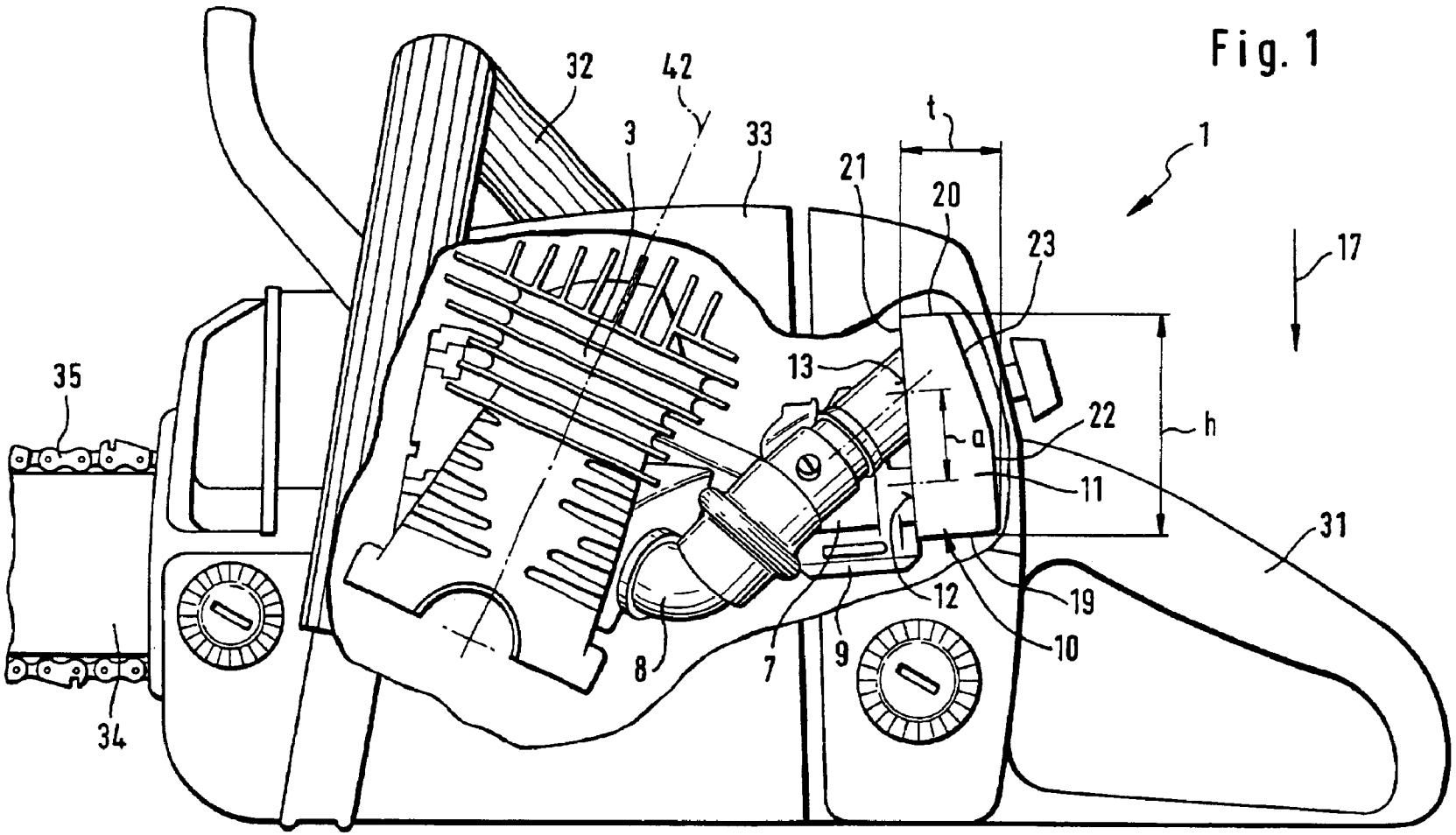
FIG. 1 is a schematic of a hand-guided work apparatus with the carburetor, air filter, intake channel and air channel mounted therein.

In FIG. 1, a hand-guided portable work apparatus 1 is shown which is here a motor-driven chain saw having a guide bar 34 and a saw chain 35. The motor-driven chain saw is schematically shown in the normal work position. The work apparatus 1 has a handle 31 which, together with the guide bar 34, fixes the longitudinal direction of the work apparatus. The handle tube 32 extends transversely to the longitudinal direction and projects above the housing 33 of the work apparatus 1. In the normal work position of the work apparatus 1, the longitudinal direction of the work apparatus is aligned approximately horizontally and the handle tube 32 extends above and laterally of the work apparatus 1. The effective direction 17 of the gravity force runs in the direction shown in FIG. 1. An internal combustion engine whose cylinder 3 is shown is mounted in the housing 33 of the work apparatus 1. The cylinder longitudinal axis 42 of the cylinder 3 runs essentially in the effective direction 17 of the gravity force in the normal work position of the work apparatus 1.

An air/fuel mixture is supplied to the cylinder 3 via an intake channel 7 and fresh air is supplied via an air channel 8. The fresh air channel and intake channel open on the clean side of the air filter 10 which has an air filter housing 11. The elevation (h) of the air filter housing 11 extends parallel to the effective direction 17 of the gravity force in the normal work position of the work apparatus 1, that is, approximately in the direction of the cylinder longitudinal axis 42 and perpendicular to the longitudinal direction of the work apparatus. The depth (t) extends parallel to the longitudinal direction and perpendicular to the effective direction 17 of the gravity force. The intake channel 7 opens with an intake opening 12 and the air channel 8 with an air channel opening 13 on the clean side of the air filter 10 on the air filter housing 11. The intake opening 12 has an elevation offset (a) to the air channel opening 13 parallel to the effective direction 17 of the gravity force. Intake opening 12 and air channel opening 13 are therefore geodetically separated. The air channel 8 and the intake channel 7 open at the front wall 21 of the air filter housing 11 which is the wall facing toward the cylinder 3 of the internal combustion engine 2. The back wall 22 of the air filter housing 11 is inclined in a region 23 to the front wall 21 of the air filter housing 11. The inclined region 23 extends from the roof 20 over approximately half of the elevation (h). The intake channel 7 is partially configured in the carburetor 9 which serves to prepare the mixture.

Figure 3:
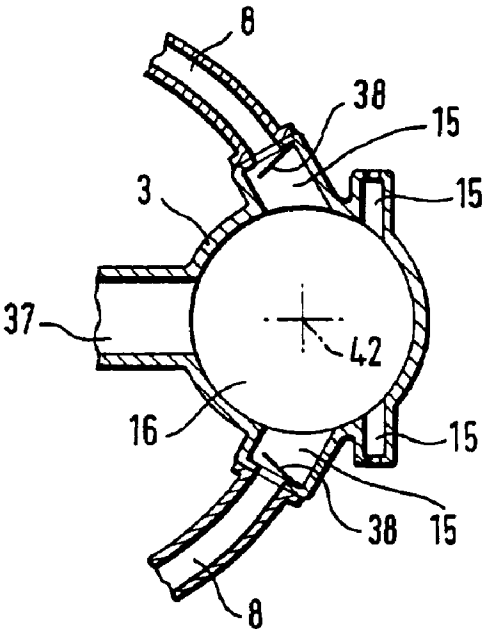
FIG. 3 is a section view taken along line III—III of FIG. 2.
Figure 2:
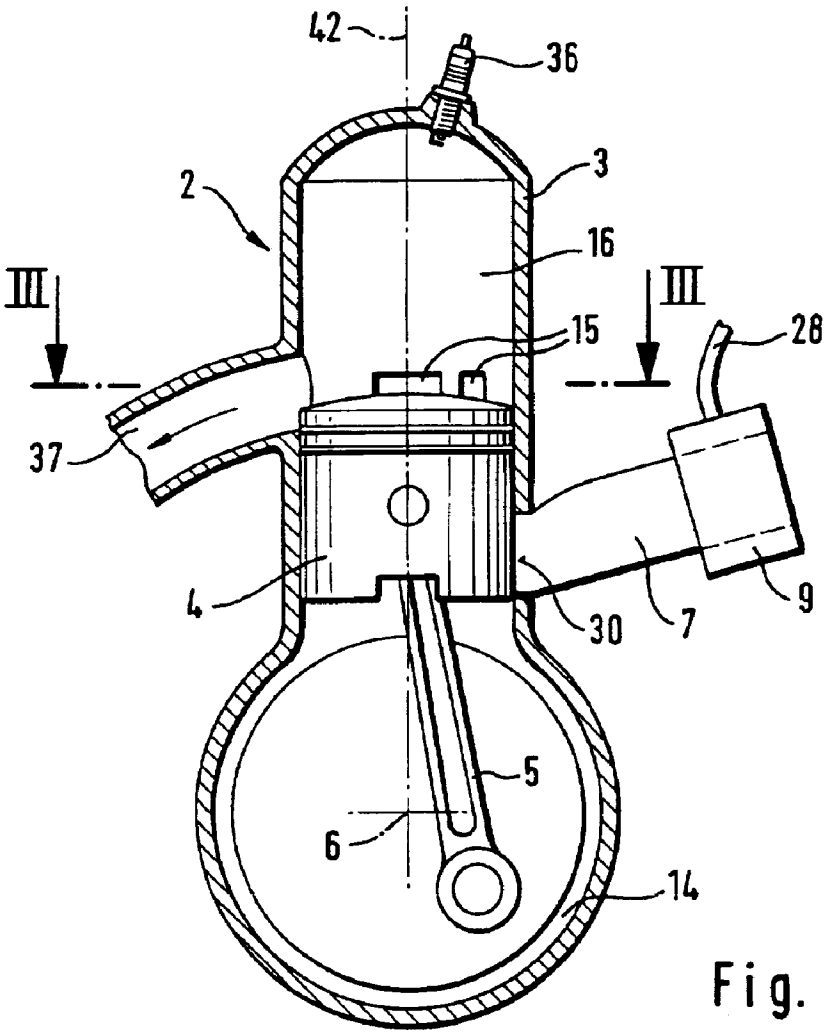
FIG. 2 is a schematic representation of a two-stroke engine.

The arrangement of air channel opening 13 and intake opening 12 with en elevation offset (a) on the clean side of the air filter 10 is especially advantageous for two-stroke engines having scavenging advance air. In the following, the operation of a two-stroke engine having scavenging advance air is explained with reference to FIGS. 2 and 3.

The internal combustion engine 2 has a cylinder 3 with a combustion chamber 16 formed therein. The combustion chamber 16 is delimited by a piston 4 moving up and down. The piston 4 drives the crankshaft via the connecting rod 5. The axis 6 of the crankshaft is shown. With an upwardly moving piston 4, an air/fuel mixture, which is prepared in the carburetor 9, is drawn from the intake channel 7 by suction via the inlet 30 into the crankcase 14. With the downward movement of the piston 4, the air/fuel mixture is compressed in the crankcase 14. The crankcase 14 is fluidly connected to the combustion chamber 16 via a total of four symmetrically arranged transfer channels 15. The transfer channels 15 are opened to the combustion chamber 16 toward the end of the compression stroke and the air/fuel mixture flows from the crankcase 14 into the combustion chamber 16. There, the mixture is compressed by the piston 4 in the upward movement and ignited by the spark plug 36. After the expansion, the exhaust gases are discharged from the combustion chamber 16 via the outlet 37 while a fresh air/fuel mixture flows into the combustion chamber 16 via the transfer channels 15.

Air channels 8 open into the transfer channels 15, especially into the transfer channels arranged close to the outlet in order to prevent uncombusted air/fuel mixture to escape via the outlet 37. The air channels 8 advantageously completely fill the transfer channels 15 with fresh air. Valves 38 are provided to control the connection of the transfer channels 15 with the air channels 8. The connection can, however, also be controlled via the piston 4, for example, by connecting transfer channel 15 and air channel 8 via a piston window. The air, which is advance stored in the transfer channels 15, separates the exhaust gases from the after-flowing air/fuel mixture and so prevents uncombusted air/fuel mixture from reaching the outlet 37. The carburetor 9 is purposefully configured as a membrane carburetor which has a compensation channel 28. The pressure level at the compensation channel 28 therefore determines the fuel quantity, which is supplied to the fuel intake channel 7, via the pressure level in the fuel reservoir of the carburetor 9.

Figure 4:
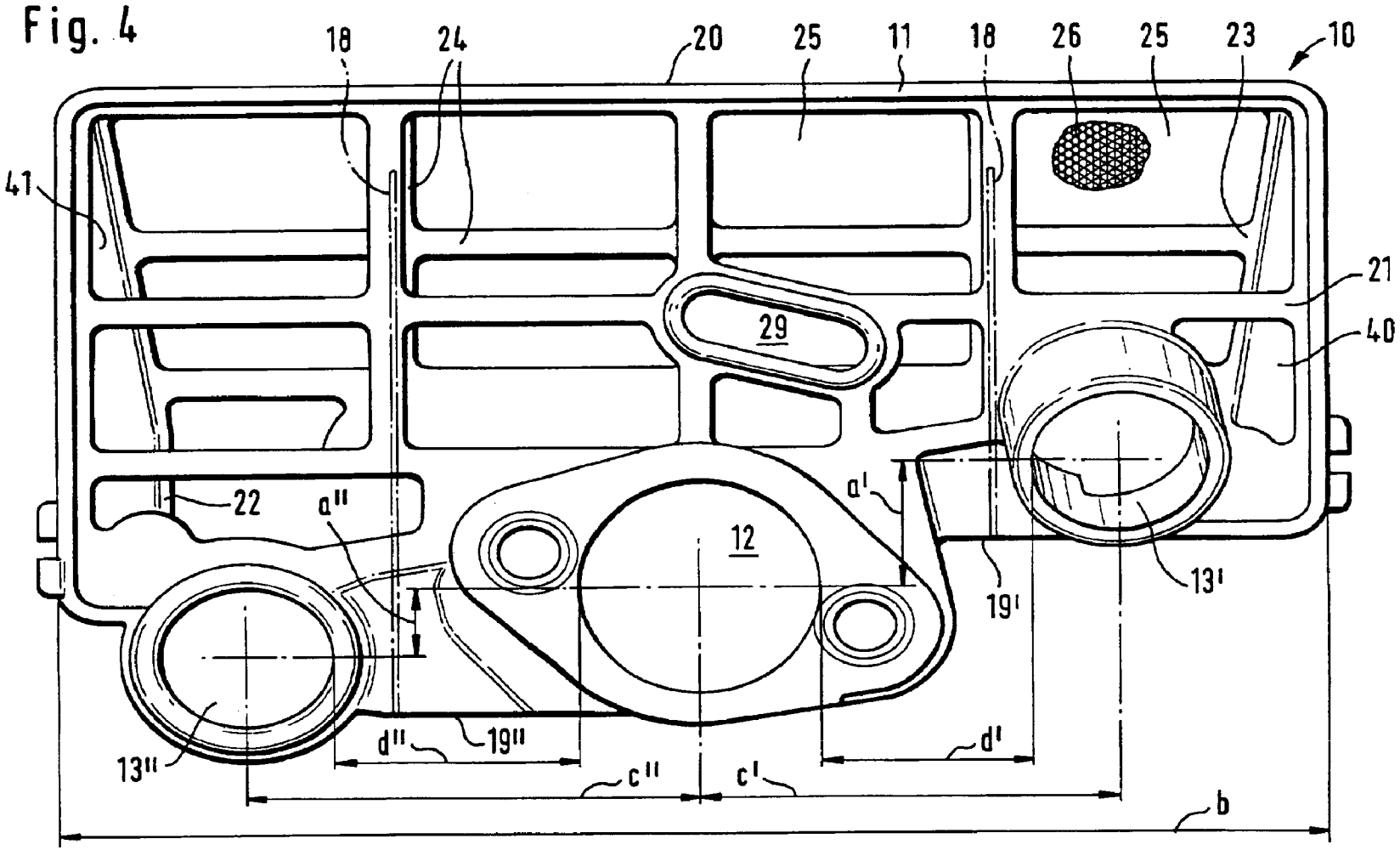
FIG. 4 is a perspective view of an air filter housing having an intake opening and two air channel openings; and, FIG. 5 is a perspective view of an air filter and the channels leading to the cylinder of an internal combustion engine.

FIG. 4 shows a perspective view onto the front wall 21 of an air filter housing 11. The following open into the air filter housing 11: the intake channel 7 via the intake opening 12; two air channels 8 via air channel openings 13' and 13"; and, the compensation channel 28 of a membrane carburetor 9 via the opening 29. All channels open into the front wall 21 of the air filter housing 11. The front wall 21 and the back wall 22, which is arranged opposite the front wall 21, are formed from ribs 24 which separate air openings 25 from each other. The air openings 25 are purposefully covered with filter material 26. The filter material 26 can extend between the ribs 24 or can cover the entire wall. The filter material 26 is supported by the ribs 24.

The air filter housing 11 has a width (b) which extends perpendicularly to the elevation (h), which is shown in FIG. 1, and the depth (t). The width (b) extends especially approximately perpendicular to the flow direction in the intake channel 7 arranged on the air filter housing 11. As shown in FIG. 4, the base 19 is subdivided over the width (b) of the air filter housing 11 into sections (19', 19"). The section 19" lies below the section 19' seen in the effective direction 17 of the gravity force or in the direction of the cylinder longitudinal axis 42. As shown in FIG. 1, the base 19 is the region of the air filter housing 11 lying in the effective direction 17, that is, the region lying below in the normal work position of the work apparatus 1 while the roof 20 is the region of the air filter housing 11 lying above and opposite. Referring to the combustion engine 2, the roof 20, as seen in the direction of the cylinder longitudinal axis 42, is thereby the region facing toward the cylinder 3 and the base 19 is the region facing toward the crankcase 14. The intake opening 12 is arranged approximately in the center referred to the width (b) of the air filter housing 11 and arranged in the region of the base 19" of the air filter housing.

Seen in the direction of width (b), air channel openings 13' and 13" are arranged laterally of the intake opening 12. The air channel openings 13' and 13" have a lateral offset (c') and (c"), respectively, to the intake opening 12. The respective offsets (c') and (c") are so large that the openings have respective lateral sections (d') and (d"). An adjusting wall 18 is mounted between each two openings and extends over the entire depth (t) of the air filter housing. The adjusting walls 18 extend from bases 19' and 19", respectively, up to below the roof 20 of the air filter housing 11. The walls 18 have a spacing to the roof 20. The clean air path and the mixture path are separated completely from each other by the adjusting walls 18. With the spacing of the adjusting walls 18 to the roof 20, the clean side of the air filter 10 is configured as a communicating clean space which is subdivided into several chambers. Furthermore, the openings 12, 13', 13" have respective elevation offsets (a') and (a"). The air channel opening 13" is below the intake opening 12, that is, the air channel opening 13" is arranged in the effective direction 17 of the gravity force with an elevation offset (a") and the air channel opening 13', viewed in the direction of width (b), is on the opposite-lying side above the intake opening 12, that is, opposite the effective direction 17 of the gravity force at an elevation offset (a').

The opening 29 of the compensation channel 28 is arranged above the intake opening 12 but at a small lateral offset. In this way, the same pressure is present at the compensation channel 28 as at the intake opening 12 and the air channel openings (13', 13"). The back wall 22 of the air filter housing 11 is in a region 23, which extends from the roof 20 to approximately the elevation of the intake opening, inclined toward the front wall 21. In this way, favorable flow conditions are provided as well as favorable mounting conditions. Roof 20, base 19 and the side walls (40, 41) are advantageously configured to be massive, that is, they have no air openings 25. The side walls (40, 41) extend at an elevation (h) and a depth (t).

Figure 5:
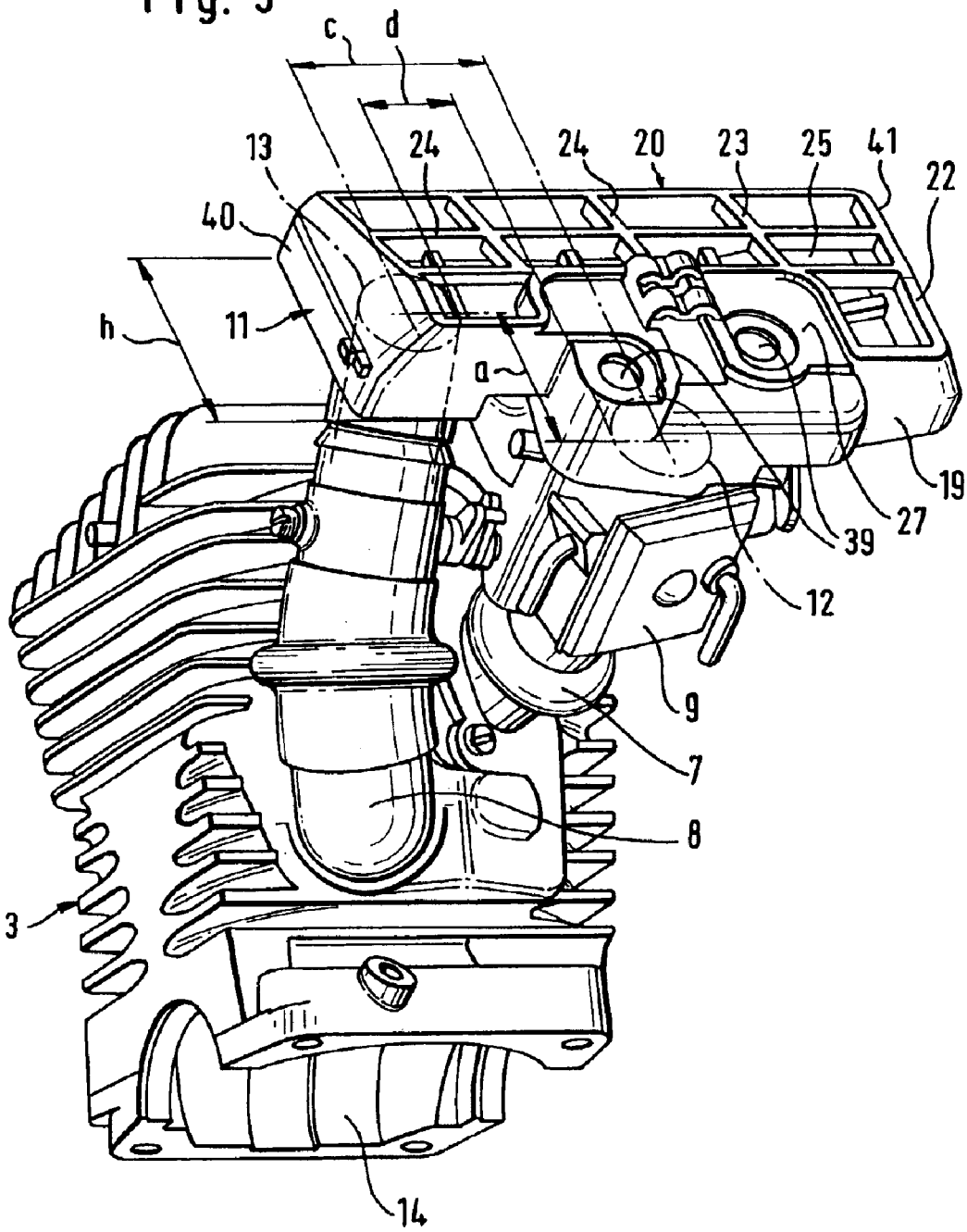

An embodiment of the invention is shown in FIG. 5. An air channel 8 as well as an intake channel 7 lead to the cylinder 3 of an internal combustion engine. In contrast to the three-channel internal combustion engine shown in FIG. 4 (that is, with two air channels and one mixture channel), the internal combustion engine shown in FIG. 5 is configured to have two channels, that is, the engine in FIG. 5 has one mixture channel and one air channel. The air channel 8 divides in the wall of the cylinder 3. The intake channel 7 is partially formed by a membrane carburetor 9. The air channel 8 opens via the air channel opening 13 and the intake channel 7 opens via the intake opening 12 on the front wall 21 of the air filter housing 11, that is, at the side facing toward the cylinder 3 of the engine. The intake opening 12 and the air channel opening 13 exhibit an elevation offset (a) in the direction of the elevation (h) of the air filter housing and also exhibit a width offset (c) perpendicular to the elevation (h). The width offset (c) is so large that a horizontal distance (d) is formed between air channel opening 13 and intake opening 12. The intake opening 12 opens in the region of the base 19 into the air filter housing. The region 27 of the back wall 22 of the air filter housing 11 lies opposite the intake opening 12 and has no air openings 25; instead, the region 27 is formed essentially of solid material. Only two openings 39 are provided for fixing the air filter housing 11 on the carburetor 9 by means of attachment means projecting through the air filter housing 11 in this region. Air openings 25 are preferably provided in the front wall 21 and the back wall 22. Roof 20, base 19 and the side walls 40 and 41 are configured as solid walls. The side walls 40 and 41 extend in the direction of elevation (h) and in the longitudinal direction of the work apparatus.

In addition to the elevation offset between the intake opening 12 and air channel opening 13, it can be purposeful to provide an adjusting wall between these openings. The air channel opening 13 is purposefully arranged above an intake channel opening 12; however, it can also be practical to arrange the air channel opening below the intake opening 12.

The geodetic separation of the intake opening 12 and the air channel opening 13 can be purposefully combined with known solutions such as baffle pots or air resistance elements.

It is understood that the foregoing description is that of the preferred embodiments of the invention and that various changes and modifications may be made thereto without departing from the spirit and scope of the invention as defined in the appended claims.

What is claimed is:

1. A portable, handheld work apparatus which has a normal work position during operation thereof, the portable handheld work apparatus comprising:

an internal combustion engine having an air channel and an intake channel;

a carburetor defining a portion of said intake channel;

an air filter having a clean side and being mounted upstream of said carburetor;

said air channel and said intake channel fluidly connecting said engine to said clean side of said air filter;

said clean side having an air channel opening and an intake channel opening formed therein;

said air channel opening into said air channel opening and said intake channel opening into said intake channel opening;

said air channel opening and said intake channel opening are spacially separated relative to each other at said clean side;

said intake channel opening being offset in elevation relative to said air channel opening viewed in the acting direction of gravitational force when said work apparatus is in said normal work position; and, the spacial separation of said air channel opening and said intake channel opening and said offset coacting to prevent a passing of fuel from said intake channel into said air channel.

2. The work apparatus of claim 1, said air filter having a housing; said housing having a width (b) defined by a dimension approximately perpendicular to the flow direction in said intake channel and approximately perpendicular to said acting direction of said gravitational force while said work apparatus is in said normal work position; said housing having an elevation (h) defined by a dimension approximately parallel to said acting direction of said gravitational force while said work apparatus is in said normal work position and perpendicular to said width (b); and, said housing having a depth (t) defined by a dimension perpendicular to said width (b) and said elevation (h).

3. The work apparatus of claim 2, wherein said width (b) is greater than maid depth (t).

4. The work apparatus of claim 2, wherein said intake channel opening is disposed below said air channel opening.

5. The work apparatus of claim 2, said intake channel opening and said air channel opening are disposed in spaced relationship to each other viewed in said width (b) by a width offset.

6. The work apparatus of claim 5, wherein said intake channel opening and said air channel opening are at a distance from each other viewed in said width (b) and measured from the respective edges of said openings.

7. The work apparatus of claim 2, said housing having at least one adjusting wall mounted therein for spatially separating said intake channel opening and said air channel opening from each other; and, said adjusting wall having at least one edge at a distance from said housing.

8. The work apparatus of claim 7, wherein said adjusting wall is arranged approximately parallel to the flow direction in said intake channel.

9. The work apparatus of claim 7, wherein said adjusting wall extends over the entire depth (t) of said housing.

10. The work apparatus of claim 7, wherein said adjusting wall extends over a large portion of said elevation (h) of said air filter housing.

11. A portable, handheld work apparatus which has a normal work position during operation thereof, the portable handheld work apparatus comprising:

an internal combustion engine having an air channel and an intake channel;

a carburetor defining a portion of said intake channel;

an air filter having a clean side and being mounted upstream of said carburetor;

said air channel and said intake channel fluidly connecting said engine to paid clean aide of said air filter;

said clean side having an air channel opening and an intake channel opening formed therein;

said air channel opening into said air channel opening an said intake channel opening into said intake channel opening;

said air channel opening and said intake channel opening are disposed in spaced relationship to each other at said clean side;

said intake channel opening being offset in elevation relative to said air channel opening viewed in the acting direction of gravitational force when said work apparatus is in said normal work position, wherein said air filter has a housing;

said housing having a width (b) defined by a dimension approximately perpendicular to the flow direction in said intake channel and approximately perpendicular to said acting direction of said gravitational force while said work apparatus is in said normal work position;

said housing having an elevation (h) defined by a dimension approximately parallel to said acting direction of said gravitational force while said work apparatus is in said normal work position and perpendicular to said width (b);

said housing having a depth (t) defined by a dimension perpendicular to said width (b) and said elevation (h);

said housing having at least one adjusting wall mounted therein for spacially separating said intake channel opening and said air channel opening from each other;

said adjusting wall having at least one edge at a distance from said housing; and wherein said housing has a base and a roof; and said adjusting wall extends from said base of said air filter housing up to below said roof.

12. The work apparatus of claim 2, wherein said air filter housing has air openings and ribs formed therein separating said air openings from each other; and, a filter material covers said air openings.

13. The work apparatus of claim 2, wherein said air filter housing has a front wall facing toward said internal combustion engine; and, said air channel opening and said intake channel opening are in said front wall.

14. The work apparatus of claim 13, wherein said air filter housing has A back wall facing away from maid internal combustion engine; and, said back wall has a portion thereof inclined toward said front wall.

15. The work apparatus of claim 14, wherein said back wall has an additional portion lying opposite said intake channel opening; and, said additional portion has no openings formed therein.

16. The work apparatus of claim 1, wherein said carburetor is a membrane carburetor having a compensation channel opening in spaced relationship to said intake channel opening.

17. The work apparatus of claim 16, wherein said compensation channel opens into said air filter on said clean side thereof opposite to the acting direction of said gravitational force.

* * * * *

UNITED STATES PATENT AND TRADEMARK OFFICE

CERTIFICATE OF CORRECTION

PATENT NO. : 6,880,515 B2
DATED : April 19, 2005
INVENTOR(S) : Werner Geyer et al.

It is certified that error appears in the above-identified patent and that said Letters Patent is hereby corrected as shown below:

Column 2,
Line 29, delete “ham” and insert -- has -- therefor.

Column 3,
Line 51, delete “en” and substitute -- an -- therefor.

Column 6,
Line 55, delete “maid” and insert -- said -- therefor.

Column 7,
Line 22, delete “paid clean aide” and substitute -- said clean side -- therefor.

Column 8,
Line 25, delete “A” and substitute -- a -- therefor.
Line 25, delete “maid” and substitute -- said -- therefor.

Signed and Sealed this

Fourteenth Day of June, 2005

JON W. DUDAS
*Director of the United States Patent and Trademark Office*